US012263871B2

(12) United States Patent
Krause et al.

(10) Patent No.: US 12,263,871 B2
(45) Date of Patent: Apr. 1, 2025

(54) RAIL VEHICLE FOR TRANSPORTING PASSENGERS

(71) Applicant: Siemens Mobility GmbH, Munich (DE)

(72) Inventors: Martin Krause, Rheinberg (DE); Helmut Treutler, Krefeld (DE); Markus Wilhelm, Moenchengladbach (DE)

(73) Assignee: Siemens Mobility GmbH, Munich (DE)

( * ) Notice: Subject to any disclaimer, the term of this patent is extended or adjusted under 35 U.S.C. 154(b) by 855 days.

(21) Appl. No.: 17/059,585

(22) PCT Filed: Apr. 29, 2019

(86) PCT No.: PCT/EP2019/060868

§ 371 (c)(1),
(2) Date: Nov. 30, 2020

(87) PCT Pub. No.: WO2019/228727

PCT Pub. Date: Dec. 5, 2019

(65) Prior Publication Data

US 2021/0213980 A1 Jul. 15, 2021

(30) Foreign Application Priority Data

May 29, 2018 (DE) ..... 10 2018 208 452.1

(51) Int. Cl.

| | |
|---|---|
| ***B61D 17/06*** | (2006.01) |
| ***B61D 1/00*** | (2006.01) |
| ***B61D 17/10*** | (2006.01) |
| ***B61D 17/12*** | (2006.01) |

(52) U.S. Cl.
CPC ..... *B61D 17/06* (2013.01); *B61D 1/00* (2013.01); *B61D 17/10* (2013.01); *B61D 17/12* (2013.01)

(58) Field of Classification Search
CPC ..... B61D 17/06; B61D 1/00; B61D 17/10; B61D 17/12; B61D 17/048; B61D 17/00; B61D 1/04; B61C 17/00
See application file for complete search history.

(56) References Cited

U.S. PATENT DOCUMENTS

| | | | |
|---|---|---|---|
| 11,124,205 B2 | 9/2021 | Wagniere | |
| 2018/0029614 A1 | 2/2018 | Mull et al. | |

FOREIGN PATENT DOCUMENTS

| | | | | |
|---|---|---|---|---|
| DE | 19530645 A1 * | 3/1996 | ..... | B61D 1/00 |
| DE | 102015202991 * | 8/2016 | ..... | B61C 17/00 |
| DE | 102015202991 A1 | 8/2016 | | |

(Continued)

*Primary Examiner* — Robert J McCarry, Jr.
(74) *Attorney, Agent, or Firm* — Laurence A. Greenberg; Werner H. Stemer; Ralph E. Locher

(57) ABSTRACT

A rail vehicle for transporting passengers includes at least one car body, a passenger compartment situated in the car body, an underfloor region, an inner ceiling region, and a plurality of device containers for receiving vehicle components. The passenger compartment includes a first end wall region and a second end wall region which is situated opposite the first end wall region. In order to enable a great configuration freedom for the passenger compartment, it is provided that each device container of the rail vehicle is disposed in one of the above-mentioned regions.

20 Claims, 3 Drawing Sheets

(56) References Cited

FOREIGN PATENT DOCUMENTS

| | | | | | |
|---|---|---|---|---|---|
| DE | 102016208272 | A1 | | 11/2017 | |
| EP | 0071689 | A1 | | 2/1983 | |
| EP | 3045371 | A1 | | 7/2016 | |
| EP | 0599235 | A1 | * | 8/2016 | |
| ES | 2307141 | T3 | * | 11/2008 | ..... B60Q 3/0246 |
| WO | WO-2012037953 | A1 | * | 3/2012 | ..... B61D 17/00 |
| WO | WO-2016041478 | A1 | * | 3/2016 | ..... B61D 17/12 |
| WO | 2017148529 | A1 | | 9/2017 | |

* cited by examiner

RAIL VEHICLE FOR TRANSPORTING PASSENGERS

BACKGROUND OF THE INVENTION

Field of the Invention

The invention relates to a rail vehicle for transporting passengers, which comprises a coach body, a passenger compartment arranged in the coach body, an underfloor region, an inner ceiling region, and a plurality of device containers for accommodating vehicle components, wherein the passenger compartment comprises a first end wall region and a second end wall region, which is arranged opposite the first end wall region.

Rail vehicle operators often wish to be able to structurally configure the passenger compartment of a rail vehicle as freely as possible. For example, rail vehicle operators would like to be able to decide whether a certain subarea of the passenger compartment is to be utilized as a multi-purpose area, in which, inter alia, wheelchair users, cyclists, and/or persons with strollers may ride, as a seating area, or as a restroom area.

Modern rail vehicles are equipped with a plurality of, in particular, electrical vehicle components, such as vehicle control components and/or components of a passenger information system, which are typically accommodated in device containers. The device containers may require a large amount of space and prevent a free configurability of the passenger compartment.

SUMMARY OF THE INVENTION

One object of the invention is to allow for a great configuration freedom for the passenger compartment in the case of a rail vehicle of the type mentioned at the outset.

This object is achieved according to the invention by a rail vehicle having the features described below.

Advantageous refinements of the rail vehicle according to the invention are the object of the dependent claims as well as the following description.

The rail vehicle according to the invention for transporting passengers comprises a coach body, a passenger compartment arranged in the coach body, an underfloor region, an inner ceiling region, and a plurality of device containers for accommodating vehicle components, wherein the passenger compartment comprises a first end wall region and a second end wall region, which is arranged opposite the first end wall region. According to the invention, it is provided that each device container of the rail vehicle is arranged in one of the aforementioned regions. This means, it is provided that the particular device container is arranged in the underfloor region, in the inner ceiling region, in the first end wall region, or in the second end wall region.

The wording that each device container of the rail vehicle is arranged in one of the aforementioned regions is not necessarily to be understood to mean that, according to the invention, all device containers are to be arranged in the same region. Rather, the aforementioned wording is to be understood to mean that none of the device containers of the rail vehicle is to be arranged anywhere other than in one of the aforementioned regions (underfloor region, inner ceiling region, first end wall region, second end wall region), wherein the individual device containers can certainly be arranged in different regions.

A device container that is arranged in the underfloor region or in the inner ceiling region is located outside the passenger compartment. Consequently, such a device container takes up no space in the passenger compartment and also does not negatively affect the configurability of the passenger compartment.

Since, in the region of an end wall delimiting the passenger compartment, such as a coach body end wall or a partition wall separating the passenger compartment from a driver compartment, the configurability of the passenger compartment is limited by the end wall anyway, the configurability of the passenger compartment is not or is only negligibly affected by a device container arranged in one of the end wall regions of the passenger compartment. Compared to an arrangement of a device container in another region of the passenger compartment, the arrangement of a device container in one of the end regions of the passenger compartment offers a greater configuration freedom for the passenger compartment.

The rail vehicle is preferably a single coach, which is coupleable to other coaches to form a rail vehicle system. The rail vehicle can be a carriage (i.e., a coach without self-propulsion) or a railcar (i.e., a coach with self-propulsion).

The rail vehicle can be equipped with one or multiple running gear(s), in particular one or multiple wheel truck(s), wherein the type of the running gear(s) and/or the positioning of the running gear(s) are/is arbitrary, in principle.

In the present case, a device container is understood to be a container, which is prepared for accommodating one or multiple vehicle component(s), in particular one or multiple electrical, pneumatic and/or hydraulic vehicle component(s). For example, the particular device container of the rail vehicle can be designed as a (device) cabinet.

The particular device container can comprise a housing, in particular a metallic housing. Advantageously, the housing is a fireproof housing.

Moreover, the particular device container of the rail vehicle can comprise an openable and closeable door or flap, which can be mounted, in particular, in a pivotable and/or removable manner. The door or flap allows for an easy accessibility to vehicle components arranged in such a device container, for example, for maintenance purposes.

Moreover, the particular device container can comprise, on at least one of its walls, an interface for signal transmission and/or for power supply.

The coach body of the rail vehicle comprises a floor and a ceiling (referred to in the following as the coach body floor and the coach body ceiling). In addition, the coach body comprises a first lateral wall and a second lateral wall, which is arranged opposite the first lateral wall (referred to in the following as the first coach body lateral wall and the second coach body lateral wall, respectively). The longitudinal extension of the particular coach body lateral wall extends in the longitudinal direction of the vehicle. Moreover, the coach body comprises a first coach body end and a second coach body end with respect to the longitudinal direction of the vehicle.

In the present case, the underfloor region is understood to be a region of the rail vehicle underneath the coach body floor. The underfloor region of the rail vehicle extends in the longitudinal direction of the vehicle preferably from the first coach body end to the second coach body end.

The rail vehicle can comprise a floor pan, if necessary. In such a case, at least one portion of the underfloor region can be delimited by the floor pan in the width direction of the vehicle.

The inner ceiling region is understood to be a region between an inner ceiling of the rail vehicle and the coach body ceiling. Advantageously, the inner ceiling region of the rail vehicle is delimited toward the bottom by the inner ceiling and toward the top by the coach body ceiling. Preferably, the inner ceiling region of the rail vehicle extends in the longitudinal direction of the vehicle from the first coach body end to the second coach body end.

In the present case, an end wall region of the passenger compartment is understood to be a region of the passenger compartment, which extends along the longitudinal direction of the vehicle from an end wall delimiting the passenger compartment to a plane extending through the coach body perpendicularly to the longitudinal direction of the vehicle, which has a distance of 50 cm to this end wall. In height, such an end wall region can extend, for example, from the coach body floor to the inner ceiling. In the width direction of the vehicle, such an end wall region can extend, for example, from the first coach body lateral wall to the second coach body lateral wall.

Moreover, an arrangement of a device container in one of the end wall regions of the passenger compartment is understood to be an arrangement in which the device container is located at least partially within the end wall region with respect to its extension in the longitudinal direction of the vehicle. Preferably, a device container of the rail vehicle that is arranged in one of the end wall regions is located largely, in particular completely, within the aforementioned end wall region with respect to its extension in the longitudinal direction of the vehicle.

The passenger compartment extends, in height, preferably from the coach body floor to the inner ceiling. In the width direction of the vehicle, the passenger compartment preferably extends from the first coach body lateral wall to the second coach body lateral wall.

Advantageously, at least one vehicle component is accommodated in each of the device containers of the rail vehicle. The vehicle components accommodated in the device containers are preferably electrical, pneumatic and/or hydraulic vehicle components.

It can be provided that one or multiple safety-relevant vehicle component(s) is/are arranged in at least one of the device containers. In particular, it can be provided that exclusively one or multiple safety-relevant vehicle component(s) (i.e., no non-safety-relevant vehicle components) is/are arranged in at least one of the device containers.

In the present case, safety-relevant vehicle components are understood to be components of the rail vehicle that are necessary for a safe driving operation of the rail vehicle. The safety-relevant vehicle components of the rail vehicle can comprise, for example, braking system components (such as a compressed-air tank, a brake controller for a pneumatic brake and/or a brake controller for an electrical brake), vehicle electrical system devices, diagnostic devices and/or vehicle control components. In particular, the safety-relevant vehicle components can comprise vehicle components that are required for the running capability of the rail vehicle in case of fire, for example, according to the standard DIN EN 50553:2016.

Moreover, it can be provided that one or multiple non-safety-relevant vehicle component(s) is/are arranged in at least one of the device containers. In particular, it can be provided that exclusively one or multiple non-safety-relevant vehicle component(s) (i.e., no safety-relevant vehicle components) is/are arranged in at least one of the device containers.

In the present case, non-safety-relevant vehicle components are understood to be components of the rail vehicle that do not belong to the group of the safety-relevant vehicle components. The non-safety-relevant vehicle components can comprise, for example, components of a passenger information and/or passenger entertainment system, components of a video monitoring system and/or components for storing (video) data.

Preferably, at least one of the device containers is arranged in the underfloor region. (Such a device container arranged in the underfloor region of the rail vehicle is also referred to in the following as an underfloor container.)

The arrangement of a device container in the underfloor region of the rail vehicle is advantageous, in particular, for the case in which one or multiple component(s) for controlling a vehicle brake is/are arranged in the device container, because brake control lines can be kept short in such a case.

In addition, it is preferred when at least one of the device containers is arranged in the inner ceiling region. (Such a device container arranged in the inner ceiling region of the rail vehicle is also referred to in the following as an inner ceiling container.)

The arrangement of a device container in the inner ceiling region of the rail vehicle advantageous, in particular, for the case in which one or multiple component(s) of a video monitoring system is/are arranged in the device container, because data transmission lines to video cameras (typically arranged at the inner ceiling) can be kept short in such a case.

Moreover, at least one of the device containers can be arranged in the first end wall region of the passenger compartment or in the second end wall region of the passenger compartment. (Such a device container arranged in the coach body end wall region is also referred to in the following as an end wall container.)

The arrangement of a device container in one of the end wall regions of the passenger compartment is advantageous, in particular, for the case in which one or multiple component(s) is/are arranged in the device container, for which an easy accessibility is required (for example, due to short maintenance intervals).

In particular, at least one of the device containers can be arranged in each of the two end wall regions. This allows for a compact design of the end wall containers, since vehicle components intended to be accommodated in an end wall container can be (evenly) distributed to the end wall container(s) arranged in the first end wall region and the end wall container(s) arranged in the second end wall region.

Preferably, the device container(s) that is/are arranged in one of the end wall regions of the passenger compartment is/are designed as a cabinet or cabinets.

In a first possible embodiment variant of the invention, the rail vehicle comprises a driver compartment and a partition wall, which separates the driver compartment from the passenger compartment, and the coach body comprises a coach body end wall delimiting the passenger compartment. In this case, the first end wall region of the passenger compartment is preferably adjacent to the coach body end wall. On the other hand, the second end wall region of the passenger compartment is preferably adjacent to the partition wall.

In a second possible embodiment variant of the invention, the coach body comprises a first coach body end wall delimiting the passenger compartment and a second coach body end wall delimiting the passenger compartment, which is arranged opposite the first coach body end wall. In this case, the first end wall region of the passenger compartment is preferably adjacent to the first coach body end wall. On the other hand, the second end wall region of the passenger compartment is preferably adjacent to the second coach body end wall.

In a third possible embodiment variant of the invention, the rail vehicle comprises a first driver compartment, a first partition wall, which separates the first driver compartment from the passenger compartment, a second driver compartment and a second partition wall, which separates the second driver compartment from the passenger compartment. Preferably, in this case, the first end wall region of the passenger compartment is adjacent to the first partition wall, while the second end wall region of the passenger compartment is adjacent to the second partition wall.

Advantageously, the first driver compartment is arranged at the first coach body end. On the other hand, the second driver compartment is advantageously arranged at the second coach body end.

In the three aforementioned embodiment variants, it can be provided that at least one of the device containers is arranged in the first end wall region, at least one of the device containers is arranged in the second end wall region, or at least one of the device containers is arranged in each of the two end wall regions.

It is particularly preferred when at least one of the device containers is arranged in at least one of the two end wall regions of the passenger compartment, in the underfloor region, and in the inner ceiling region.

The previous description of preferred embodiments of the invention contains numerous features that are represented, partly in combination, in the individual dependent claims. These features can also be considered individually, however, and combined to form meaningful further combinations. In particular, each of these features can be combined individually and in any suitable combination with the rail vehicle according to the invention.

The above-described properties, features, and advantages of the invention as well as the manner in which these are achieved will become clearer and easier to understand in conjunction with the following description of the exemplary embodiments of the invention, which are explained in greater detail in conjunction with the figures. The exemplary embodiments are utilized for explaining the invention and do not limit the invention to the combinations of features described therein, not even with regard to functional features. In addition, suitable features of each exemplary embodiment can also be considered explicitly in isolation, detached from an exemplary embodiment, introduced into another exemplary embodiment for its supplementation, and combined with any of the claims.

DETAILED DESCRIPTION OF THE INVENTION

Figure 1:
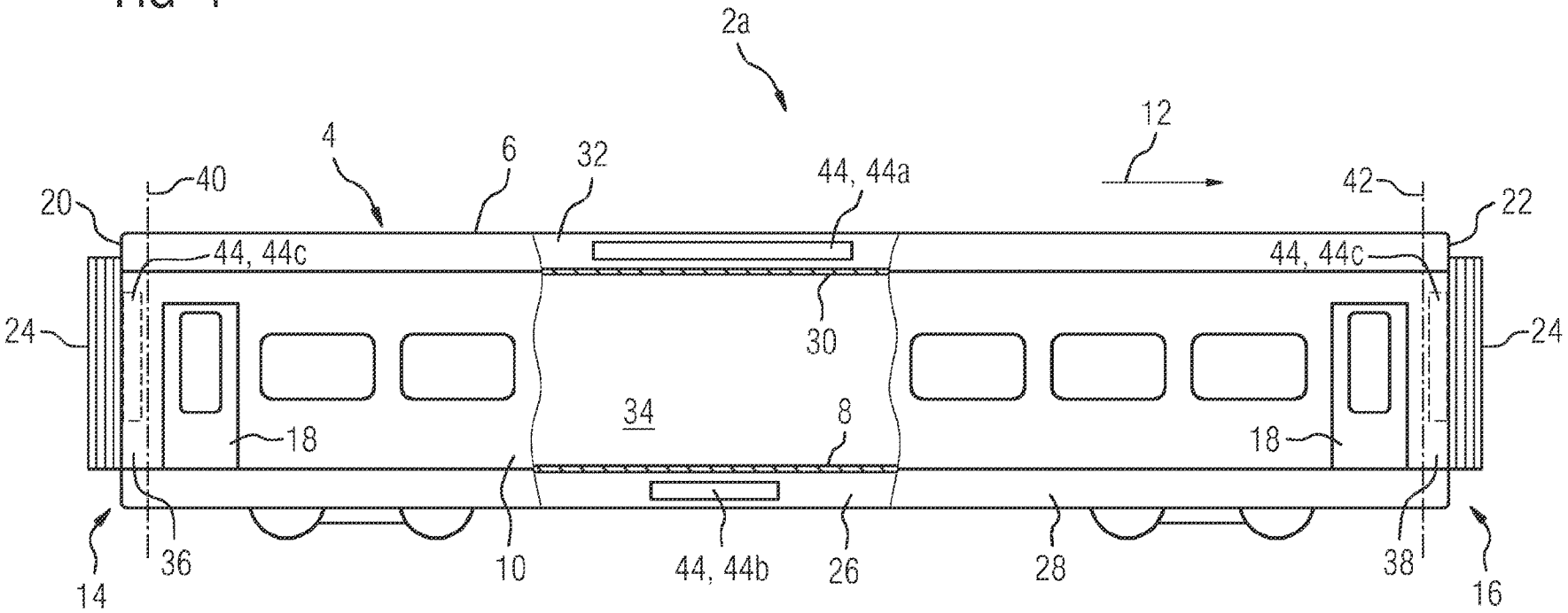
FIG. 1 shows a first exemplary embodiment of the rail vehicle according to the invention.

FIG. 1 schematically shows side view of a first rail vehicle 2*a* for transporting passengers, wherein the rail vehicle 2*a* is partially shown in a sectional representation.

The rail vehicle 2*a* comprises a coach body 4 including a coach body ceiling 6 and a coach body floor 8. The aforementioned coach body 4 comprises a first coach body lateral wall 10 as well as a second coach body wall (not visible in FIG. 1). The longitudinal extension of the particular coach body lateral wall extends in the longitudinal direction of the vehicle 12 and defines the length of the coach body 4. In the present case, the coach body 4 has a length of 27.75 m, by way of example. Moreover, the coach body 4 comprises a first coach body end 14 and a second coach body end 16 with respect to the longitudinal direction of the vehicle 12.

As is apparent from FIG. 1, the rail vehicle 2*a* comprises, at its first coach body lateral wall 10, an entry/exit door 18 close to the first coach body end 14 as well as an entry/exit door 18 close to the second coach body end 16. At the second coach body lateral wall (not visible in FIG. 1), the rail vehicle 2*a* can also comprise two such entry/exit doors, in particular in the same position with respect to the longitudinal direction of the vehicle 12 as at the first coach body lateral wall 10. In principle, another number and/or another positioning of entry/exit doors 18 are/is also possible with respect to the rail vehicle 2*a*.

At its first coach body end 14, the coach body 4 comprises a first coach body end wall 20 and at its second coach body end 16, the coach body 4 comprises a second coach body end wall 22. The two coach body end walls 20, 22 are aligned perpendicularly to the longitudinal direction of the vehicle 12. Moreover, a coach transition comprising a gangway bellows 24 is located at each of the two coach body end walls 20, 22.

Underneath the coach body floor 8, the rail vehicle 2*a* comprises an underfloor region 26, which extends in the longitudinal direction of the vehicle 12 from the first coach body end 14 to the second coach body end 16. In addition, the rail vehicle 2*a* is equipped with a floor pan 28, which delimits the underfloor region 26 in the width direction of the vehicle (i.e., perpendicularly to the plane of the drawing of FIG. 1).

Moreover, the rail vehicle 2*a* is equipped with an inner ceiling 30. Between the inner ceiling 30 and the coach body ceiling 6, the rail vehicle 2*a* comprises an inner ceiling region 32. This extends in the longitudinal direction of the vehicle 12 from the first coach body end 14 to the second coach body end 16.

In addition, the rail vehicle 2*a* comprises a passenger compartment 34. The passenger compartment 34 is delimited by each of the two coach body end walls 20, 22. This means, the passenger compartment 34 extends in the longitudinal direction of the vehicle 12 from the first coach body end wall 20 to the second coach body end wall 22. The passenger compartment 34 is delimited downward by the coach body floor 8. The passenger compartment 34 is delimited upward by the inner ceiling 30. In the width direction of the vehicle, the passenger compartment 34 extends from the first coach body lateral wall 10 to the second coach body lateral wall (not visible in FIG. 1).

Moreover, the passenger compartment 34 comprises a first end wall region 36, which is adjacent to the first coach body end wall 20, and a second end wall region 38, which is adjacent to the second coach body end wall 22.

The first end wall region 36 extends in the longitudinal direction of the vehicle 12 from the first coach body end wall 20 to a first plane 40, which extends through the coach body 4 perpendicularly to the longitudinal direction of the vehicle 12 and has a distance, in the longitudinal direction of the vehicle 12, of 50 cm to the first coach body end wall 20. The second end wall region 38 extends in the longitudinal direction of the vehicle 12 from a second plane 42, which extends through the coach body 4 perpendicularly to the longitudinal direction of the vehicle 12 and has a distance of 50 cm to the second coach body end wall 22, up to the second coach body end wall 22. In height, both end wall regions 36, 38 extend from the coach body floor 8 to the inner ceiling 30. In the width direction of the vehicle, both end wall regions 36, 38 extend from the first coach body lateral wall 10 to the second coach body lateral wall (not visible in FIG. 1).

The rail vehicle 2*a* is also equipped with multiple device containers 44, wherein each device container 44 of the rail vehicle 2*a* is arranged in one of the aforementioned regions, i.e., in the underfloor region 26, in the inner ceiling region 32, in the first end wall region 36, or in the second end wall region 38.

In the present exemplary embodiment, one of the device containers 44 is an inner ceiling container 44*a*, i.e., a device container 44 arranged in the inner ceiling region 32. One other of the device containers 44 is an underfloor container 44*b*, i.e., a device container 44 arranged in the underfloor region 26. The remaining device containers 44 of the rail vehicle 2*a* in the present exemplary embodiment are end wall containers 44*c*, i.e., device containers 44, which are each arranged in one of the end wall regions 36, 38 of the passenger compartment 34. The end wall containers 44*c* are preferably designed as cabinets (end wall cabinets) and each comprise at least one openable and closeable door.

In FIG. 1, an end wall container 44*c* arranged in the first end wall region 36 of the passenger compartment 34 and an end wall container 44*c* is arranged in the second end wall region 38 of the passenger compartment 34 are shown. The rail vehicle 2*a* can comprise a further end wall container, if necessary, in the particular end wall region 36, 38 of the passenger compartment 34—in the width direction of the vehicle—in front of or behind the particular end wall container 44*c*.

The inner ceiling container 44*a* can be fastened at the coach body ceiling 6, for example, with the aid of a supporting frame (not represented in the figure). Correspondingly, the underfloor container 44*b* can be fastened at the coach body floor 8, for example, with the aid of a supporting frame (not represented in the figure). The end wall containers 44*c* are each preferably fastened at the particular coach body end wall 20, 22 with the aid of one or multiple fastening rails, in particular, one or multiple C-rails.

In the present exemplary embodiment, safety-relevant vehicle components are accommodated in the end wall containers 44*c* as well as in the underfloor container 44*b*. On the other hand, non-safety-relevant vehicle components are accommodated in the inner ceiling container 44*a*.

Preferably, braking system components, vehicle electrical system devices, diagnostic devices and/or vehicle control components are arranged in the underfloor container 44*b*. Preferably, vehicle components that are required for the running capability of the rail vehicle 2*a* in case of fire are arranged in the end wall containers 44*c*. In particular, circuit breakers and/or control panels can be arranged in the end wall containers 44*c*. Preferably, components of a passenger information system, components of a passenger entertainment system, components of a video monitoring system and/or components for storing (video) data are arranged in the inner ceiling container 44*a*.

Due to the above-described positioning of the device containers 44, the passenger compartment 34 is largely freely configurable. For example, a restroom area and/or a multi-purpose area can be provided presently or in the future in any region of the passenger compartment 34 between the entry/exit doors 18. Alternatively, for example, the entire passenger compartment 34 between the entry/exit doors 18 can be provided as a seating area presently or in the future.

The descriptions of the following exemplary embodiments are each primarily limited to the differences with respect to the exemplary embodiment from FIG. 1, which is referenced with respect to identical features and functions. Elements that are identical and/or similar to one another are labeled with the same reference numbers, provided this is expedient, and unmentioned features are incorporated into the following exemplary embodiments without being described again.

Figure 2:
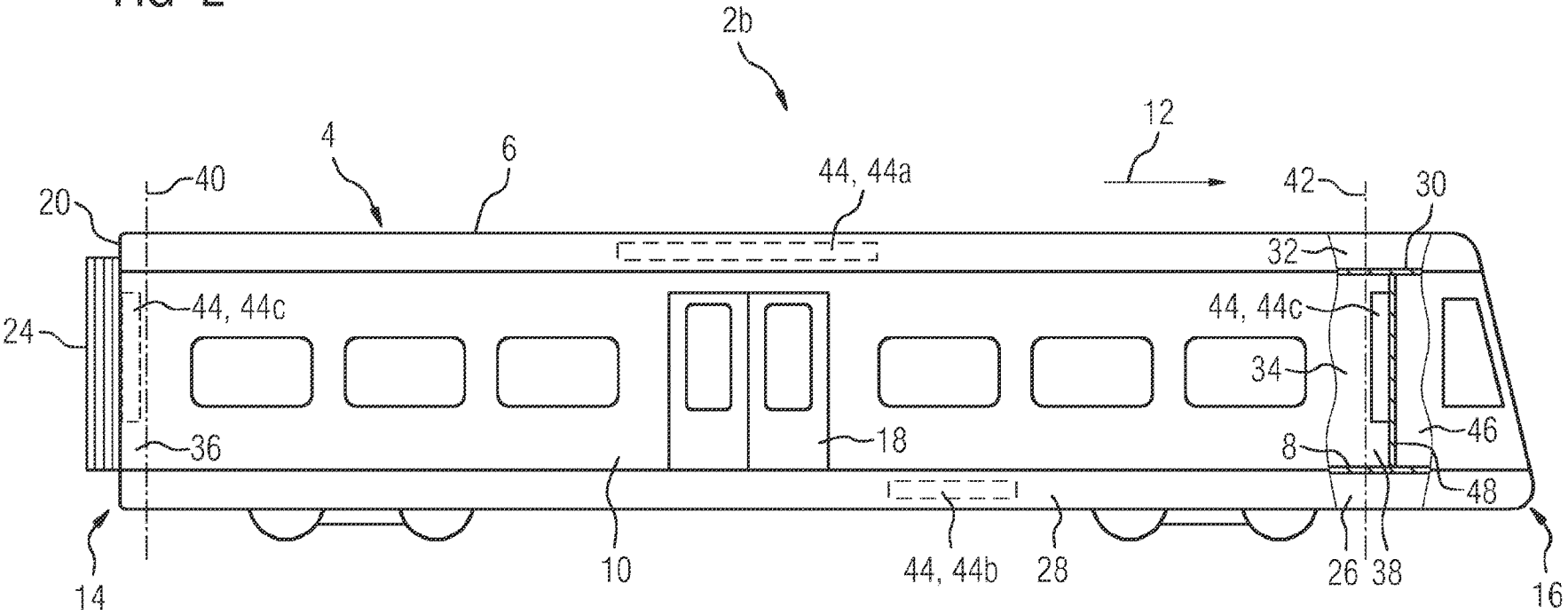
FIG. 2 shows a second exemplary embodiment of the rail vehicle according to the invention.

FIG. 2 schematically shows a second rail vehicle 2*b* for transporting passengers, which is equipped with multiple device containers 44.

This rail vehicle 2*b*—as is also the case for the rail vehicle 2*a* from FIG. 1—comprises at its first coach body end 14 a coach body end wall 20, at which a coach transition comprising a gangway bellows 24 is located. At its second coach body end 16, however, the rail vehicle 2*b* from FIG. 2 comprises a driver compartment 46.

The driver compartment 46 is separated from the passenger compartment 34 of the rail vehicle 2*b* by a partition wall 48, which is arranged opposite the coach body end wall 20, wherein the partition wall 48 is equipped with a door (not visible in FIG. 2), through which the driver compartment 46 can be entered by a driver from the passenger compartment 34.

At its coach body lateral wall 10 facing the observer, the rail vehicle 2*b* comprises an entry/exit door 18 which is arranged in the region of the vehicle center with respect to the longitudinal direction of the vehicle 12.

In the present exemplary embodiment as well, the passenger compartment 34 comprises a first end wall region 36 and a second end wall region 38. The first end wall region 36 is adjacent to the coach body end wall 20, whereas the second end wall region 38 is adjacent to the aforementioned partition wall 48.

The first end wall region 36 extends in the longitudinal direction of the vehicle 12 from the coach body end wall 20 to a first plane 40, which extends through the coach body 4 of the rail vehicle 2*b* perpendicularly to the longitudinal direction of the vehicle 12 and has a distance, in the longitudinal direction of the vehicle 12, of 50 cm to the coach body end wall 20. The second end wall region 38 extends in the longitudinal direction of the vehicle 12 from a second plane 42, which extends through the coach body 4 perpendicularly to the longitudinal direction of the vehicle 12 and has a distance, in the longitudinal direction of the vehicle 12, of 50 cm to the partition wall 48, up to the aforementioned partition wall 48.

Each device container 44 of the rail vehicle 2*b* is arranged in the underfloor region 26, in the inner ceiling region 32, in the first end wall region 36, or in the second end wall region 38.

In the present exemplary embodiment as well, one of the device containers 44 is an inner ceiling container 44*a*. One other of the device containers 44 is an underfloor container 44*b* and the remaining device containers 44 of the rail vehicle 2*b* are end wall containers 44*c*.

Figure 3:
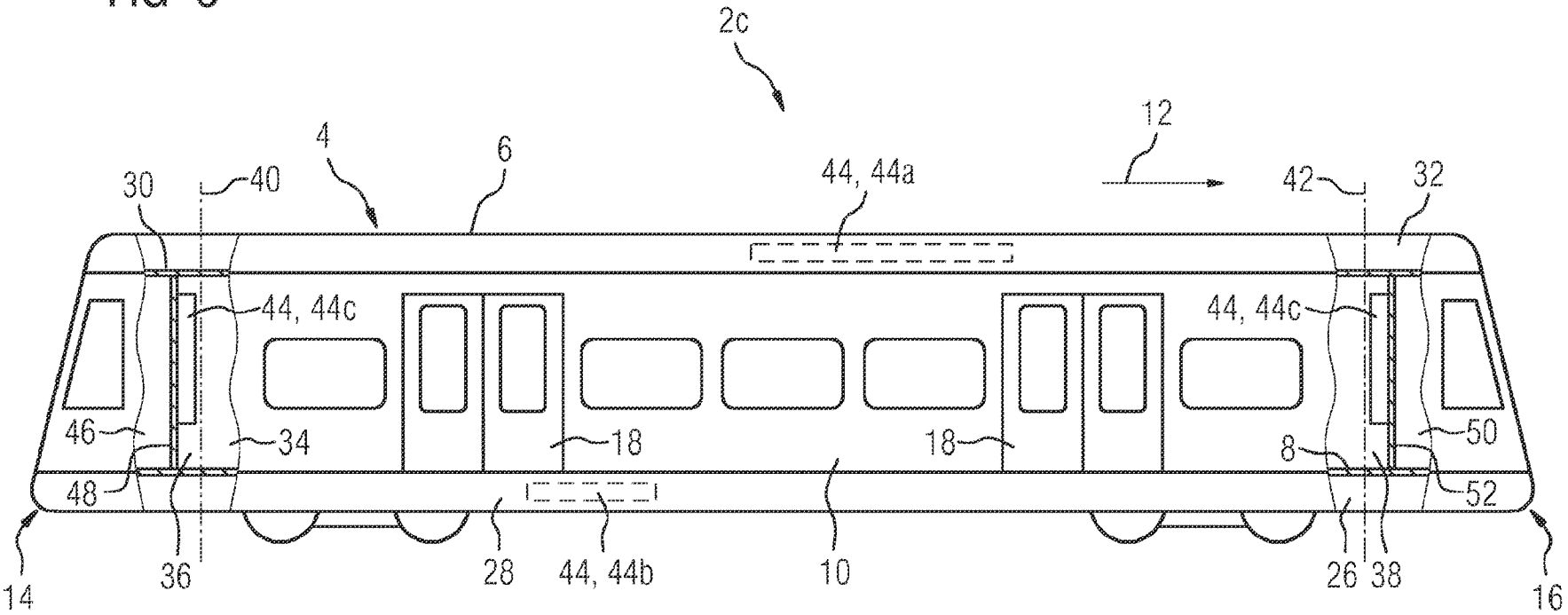
FIG. 3 shows a third exemplary embodiment of the rail vehicle according to the invention.

FIG. 3 schematically shows a third rail vehicle 2*c* for transporting passengers, which is equipped with multiple device containers 44.

This rail vehicle 2*c* comprises a first driver compartment 46 at its first coach body end 14. At its second coach body end 16, the rail vehicle 2*c* from FIG. 3 comprises a second driver compartment 50.

The first driver compartment 46 is separated from the passenger compartment 34 of the rail vehicle 2*c* by a first partition wall 48. Correspondingly, the second driver compartment 50 is separated from the passenger compartment 34 of the rail vehicle 2*c* by a second partition wall 52. Each of the two partition walls 48, 52 is equipped with a door (not visible in FIG. 3), through which the particular driver compartment 46, 50 can be entered by a driver from the passenger compartment 34.

At its coach body lateral wall 10 facing the observer, the rail vehicle 2*c* comprises two entry/exit doors 18, which are arranged closer to the vehicle center as compared to the entry/exit doors 18 of the rail vehicle 2*a* from FIG. 1.

In the case of the rail vehicle 2*c* from FIG. 3, the passenger compartment 34 comprises a first end wall region 36 and a second end wall region 38. The first end wall region 36 is adjacent to the first partition wall 48, whereas the second end wall region 38 is adjacent to the second partition wall 52.

The first end wall region 36 extends in the longitudinal direction of the vehicle 12 from the first partition wall 48 to a first plane 40, which extends through the coach body 4 of the rail vehicle 2*c* perpendicularly to the longitudinal direction of the vehicle 12 and has a distance, in the longitudinal direction of the vehicle 12, of 50 cm to the first partition wall 48. The second end wall region 38 extends in the longitudinal direction of the vehicle 12 from a second plane 42, which extends through the coach body 4 perpendicularly to the longitudinal direction of the vehicle 12 and has a distance, in the longitudinal direction of the vehicle 12, of 50 cm to the second partition wall 52, up to the second partition wall 52.

In the present exemplary embodiment as well, each device container 44 of the rail vehicle 2*c* is arranged in the underfloor region 26, in the inner ceiling region 32, in the first end wall region 36, or in the second end wall region 38.

Moreover, in the present exemplary embodiment as well, one of the device containers 44 is an inner ceiling container 44*a*. One other of the device containers 44 is an underfloor container 44*b* and the remaining device containers 44 of the rail vehicle 2*c* are end wall containers 44*c*.

Although the invention was illustrated and described in greater detail with the aid of the preferred exemplary embodiments, the invention is not limited by the described examples and other variations can be derived therefrom without departing from the scope of protection of the invention.

The invention claimed is:

1. A rail vehicle for transporting passengers, the rail vehicle comprising:
- a coach body;
- a passenger compartment disposed in said coach body, said passenger compartment including a first end wall region and a second end wall region disposed opposite said first end wall region;
- an underfloor region;
- an inner ceiling region;
- a plurality of device containers for accommodating vehicle components, each of said device containers being disposed only in a respective one of said regions, and at least one of said device containers being disposed in said inner ceiling region; and
- wherein each device container of the plurality of device containers includes an openable and closeable door or flap mounted in a pivotable and/or removable manner.

2. The rail vehicle according to claim 1, wherein at least one of said device containers is disposed in said underfloor region.

3. The rail vehicle according to claim 2, wherein one or multiple component(s) for controlling a vehicle brake is/are arranged in the device container arranged in the underfloor region.

4. The rail vehicle according to claim 1, wherein at least one of said device containers is disposed in said first end wall region of said passenger compartment or in said second end wall region of said passenger compartment.

5. The rail vehicle according to claim 1, wherein at least a respective one of said device containers is disposed in each of said first and second end wall regions.

6. The rail vehicle according to claim 5, wherein one or multiple component(s) is/are arranged in the device container in one of the end wall regions of the passenger compartment.

7. The rail vehicle according to claim 1, which further comprises:
- a driver compartment; and
- a partition wall separating said driver compartment from said passenger compartment;
- said coach body including a coach body end wall delimiting said passenger compartment;
- said first end wall region of said passenger compartment being adjacent said coach body end wall, and said second end wall region of said passenger compartment being adjacent said partition wall.

8. The rail vehicle according to claim 7, wherein:
- at least one of said device containers is disposed in said first end wall region; or
- at least one of said device containers is disposed in said second end wall region; or
- at least a respective one of said device containers is disposed in each of said first and second end wall regions.

9. The rail vehicle according to claim 1, wherein:
- said coach body includes a first coach body end wall delimiting said passenger compartment and a second coach body end wall delimiting said passenger compartment, said second coach body end wall being disposed opposite said first coach body end wall;
- said first end wall region of said passenger compartment being adjacent said first coach body end wall and said second end wall region of said passenger compartment being adjacent said second coach body end wall.

10. The rail vehicle according to claim 9, wherein:
- at least one of said device containers is disposed in said first end wall region; or
- at least one of said device containers is disposed in said second end wall region; or
- at least a respective one of said device containers is disposed in each of said first and second end wall regions.

11. The rail vehicle according to claim 1, which further comprises:
- a first driver compartment;
- a first partition wall separating said first driver compartment from said passenger compartment;
- a second driver compartment; and
- a second partition wall separating said second driver compartment from said passenger compartment;

said first end wall region of said passenger compartment being adjacent said first partition wall and said second end wall region of said passenger compartment being adjacent said second partition wall.

12. The rail vehicle according to claim 11, wherein:

at least one of said device containers is disposed in said first end wall region; or at least one of said device containers is disposed in said second end wall region; or at least a respective one of said device containers is disposed in each of said first and second end wall regions.

13. The rail vehicle according to claim 1, wherein at least a respective one of said device containers is disposed in each of:

one of said first or second end wall regions of said passenger compartment, and said underfloor region, and said inner ceiling region.

14. The rail vehicle according to claim 1, wherein the device containers are containers, which are prepared for accommodating one or multiple electrical, pneumatic and/or hydraulic vehicle component(s) and wherein the vehicle components accommodated in the device containers are electrical, pneumatic and/or hydraulic vehicle components.

15. The rail vehicle according to claim 1, wherein the device container comprises a housing, wherein the housing is a metallic housing or a fireproof housing.

16. The rail vehicle according to claim 1, wherein one or multiple safety-relevant vehicle component(s) is/are arranged in at least one of the device containers and exclusively said one or multiple safety-relevant vehicle component(s) is/are arranged in at least one of the device containers.

17. The rail vehicle according to claim 1, wherein one or multiple component(s) of a video monitoring system is/are arranged in the device container arranged in the inner ceiling region.

18. The rail vehicle according to claim 1, wherein the end wall containers are each preferably fastened at the particular coach body end wall with the aid of one or multiple fastening rails or C-rails.

19. The rail vehicle according to claim 1, wherein safety-relevant vehicle components are accommodated in the end wall containers as well as in the underfloor container and non-safety-relevant vehicle components are accommodated in the inner ceiling container.

20. The rail vehicle according to claim 1, wherein braking system components, vehicle electrical system devices, diagnostic devices and/or vehicle control components are arranged in the underfloor container and/or the vehicle components that are required for the running capability of the rail vehicle in case of fire are arranged in the end wall containers and/or components of a passenger information system, components of a passenger entertainment system, components of a video monitoring system and/or components for storing video data are arranged in the inner ceiling container.

* * * * *